United States Patent [19]

Nakamura

[11] 4,259,266

[45] Mar. 31, 1981

[54] VARIABLE-VENTURI CARBURETOR

[75] Inventor: Norihiko Nakamura, Mishimashi, Japan

[73] Assignee: Toyota Jidosha Kogyo Kabushiki Kaisha, Aichi, Japan

[21] Appl. No.: 89,131

[22] Filed: Oct. 29, 1979

[30] Foreign Application Priority Data

Feb. 21, 1979 [JP] Japan ..... 54-18406

[51] Int. Cl.[3] ..... F02M 9/06

[52] U.S. Cl. ..... 261/44 C; 261/65

[58] Field of Search ..... 261/44 C, 44 B, 65

[56] References Cited

U.S. PATENT DOCUMENTS

| | | | |
|---|---|---|---|
| 2,152,951 | 4/1939 | Bracke | 261/23 A |
| 3,784,173 | 1/1974 | Kawai et al. | 261/44 C |

FOREIGN PATENT DOCUMENTS

| | | | |
|---|---|---|---|
| 1576573 | 9/1970 | Fed. Rep. of Germany | 261/44 C |
| 1151802 | 5/1969 | United Kingdom | 261/44 C |

*Primary Examiner*—Tim R. Miles

*Attorney, Agent, or Firm*—Browdy and Neimark

[57] ABSTRACT

A variable-venturi carburetor has a throttle valve which is provided downstream in a bore, a venturi portion, a suction chamber which has a rod guide and a suction piston which is disposed perpendicularly to the venturi portion. The suction piston has a rod slidably supported by the rod guide. The carburetor also has a negative pressure chamber which is formed in the suction chamber by the suction piston, and a suction spring which is interposed between the suction chamber and the suction piston. The suction piston is adapted to be moved forward and backward due to balancing relationship appearing between the negative pressure chamber and the suction spring thereby to vary the sectional area of the venturi portion and, at the same time, move a metering needle, which is attached to the piston, forward and backward for metering fuel. In effect the fuel, as a result of suction caused by a flowing air stream, spouts from a main nozzle through which the metering needle travels. The variable-venturi carburetor has within the mixing chamber in the bore at least one bulkhead which is disposed parallel to a plane which includes therein the shaft of the throttle valve and extends in the direction of the bore axis, so that speed of flowing air will not decrease irrespective of amount of intake air. As a result, less fuel is deposited on the wall of bore in the downstream with respect to the venturi portion.

8 Claims, 4 Drawing Figures

VARIABLE-VENTURI CARBURETOR

BACKGROUND OF THE INVENTION

1. Field of the Invention

This invention concerns a variable-venturi carburetor of the type having a throttle valve which is provided downstream in a bore, a venturi portion, a suction chamber which has a rod guide and a suction piston which is disposed perpendicularly to the venturi portion. The invention relates more particularly to such a carburetor which has a rod slidably supported by the rod guide, a negative pressure chamber which is formed in the suction chamber by the suction piston, and a suction spring which is interposed between the suction chamber and the suction piston.

2. Description of the Prior Art

As is well known, as to carburetors which are attached to an engine in a vehicle such as an automobile, there are a fixed-venturi carburetor and a variable-venturi carburetor. The latter has various advantageous merits that the device height is low and that fuel metering can be made by the use of only a metering needle and a metering jet, and accordingly, a superior transient characteristic can be obtained due to less number of junctions as compared with the fixed-venturi carburetor. Thus, the variable-venturi carburetors have been widely used in practical vehicles, and further improvements and developments are being made at present and expected from now on.

In recent times, however, public pollution problems, especially problems about exhaust, gas from vehicles, have been taken up as serious problems. In the field of automobiles, with stricter regulation against public pollution, wider use of the so-called three-way catalytic converter (catalyst) is expected as a matter of course, which can treat three components of exhaust, namely HC, CO and NOx contained in the exhaust gas, changing these components into non-polluting materials at the same time in the exhaust system.

In order to permit the three-way catalytic converter to effect its full function, it is necessary to maintain the air-fuel ratio of exhaust gas, which is to encounter with the catalyst, as near as possible to the theoretical ratio of $A/F=14.7$. For this purpose, various devices, such as a feedback control mechanism utilizing $O_2$ sensor, have been proposed and developed.

Such prior art air-fuel ratio control techniques can properly control the air-fuel ratio as designed when the engine is running under the normal air-fuel ratio characteristic. Such prior art mechanisms, however, cannot assuredly offer proper control during transient stage because of time-lag wherein the mechanism cannot follow variation in air-fuel ratio, and accordingly air-fuel ratio characteristic is ruined.

In fact, as is well known, there are many acceleration and deceleration modes in actual automobile running on roads and also in the exhaust gas measurement modes which simulate the actual running. Accordingly, the above-described failure to effect the maintaining of the air-fuel ratio, within acceptable limits, caused during the transient stage is inevitable.

Accordingly, without some improved technique against the transient stages, sufficient countermeasure against exhaust gas will not be achieved.

For reasons as described above, the variable-venturi carburetor, which is superior in transient characteristic to the fixed-venturi carburetor, is now being identified as an effective apparatus having potential for the above-mentioned exhaust gas countermeasure.

When a throttle valve in conventional variable-venturi carburetors, which are usually provided downstream in a bore formed by a barrel, makes opening-and-closing operation by rotational movement thereof about its throttle shaft, a corresponding amount of air will, in response to such operation of the valve, be taken in from an air horn, which is provided upstream, and flow down through a venturi portion. With such air flow, a suction piston, which is conventionally slidably supported on a rod fitted in a rod guide extending into a suction chamber provided on one side of the barrel and is adapted to form a negative pressure chamber within the suction chamber, will be moved forward and backward. A suction spring interposed between the suction piston and the suction chamber, and the atmospheric pressure in an atmospheric air chamber which is in communication through a communication passage with the air horn is provided. Such movement of the suction piston will, in its turn, change the sectional area of the venturi portion. Concurrently with the movement of the piston, a metering needle, which is secured to the head by forcing the base portion of the needle into the head, will move forward and backward passing through a main nozzle. A metering jet is provided in the barrel while centering. In this manner, the metering needle will, in cooperation with the metering jet, meter fuel which is sucked in from a float chamber through a suction pipe and a fuel passage. This permits the fuel to spout out from the main nozzle together with bleed air drawn in through an air bleed passage which is communicated with the air horn. Such spouted fuel will then be mixed with the air flowing down through the venturi portion to form mixture of atomized fuel particles and air which will then be sent through a mixing chamber and a throttle bore into a fuel chamber. A passage for draining residual fuel is provided in the negative pressure chamber.

Differing from a fixed-venturi carburetors, variable-venturi carburetors, have a throttle bore having a sectional area two or three times as large as that of the low-speed throttle bore of fixed-venturi carburetors.

Accordingly, the sectional area of the venturi portion during operation becomes smaller to permit as smaller amount of mixed gas of fuel and air to be taken in, the mixed gas passing through the venturi portion at a speed of as high as several tens of m/sec. The speed of the gas, however, in the throttle bore will be rapidly decreased to several m/sec which is very low as compared with that in the fixed-venturi carburetors.

As a result, atomization of fuel can be enhanced by the high-speed gas stream to produce good mixing of atomized particles of fuel and air in the venturi portion. On the other hand, in the throttle bore or in the throttle bore and in the vicinity of the mixing chamber, a considerably large amount of fuel will deposit on the wall of the main bore and/or on the lower surface of the suction piston in a wet state and will drip down as irregular drips, thus causing variation in the normal air-fuel ratio characteristic and injuring operational performance. Further, in the transient stage, the amount of the deposited fuel itself will vary, thus injuring the normal, intrinsic transient characteristic of the variable-venturi carburetor, resulting in a lean state at the time of acceleration and in a rich state at the time of deceleration. Such problems as the above have been a bottle neck against maintenance of a correct air-fuel ratio which is required, as described above, for effective action of the three-way catalyst.

SUMMARY OF THE INVENTION

Bearing in mind the above-described shortcomings in the prior art especially the problem of deposition of fuel downstream in the vicinity of the bore at the time of smaller amount of intake air, it is an object of the present invention to provide a superior variable-venturi carburetor wherein the forward-and-backward movement of the suction piston relative to the amount of intake air is taken advantage of, and a bulkhead is provided in parallel with the bore axis between the suction piston and the throttle valve thereby virtually to avoid decrease in speed of mixed gas stream for preventing variation in the air-fuel ratio during the transient stage, thus as near perfect action as possible of the three-way catalytic converter is effected.

Briefly speaking the salient feature of the present invention, to achieve the above-mentioned object of the present invention, as well as others, at the time of smaller amount of intake air, the mixed gas can flow downward at a high speed through the venturi portion whose sectional area has been made narrower by means of advance of the suction piston, and, in the downstream portion to the suction piston, the mixed gas is regulated into a shape of stream similar to that in the venturi portion by a bulkhead provided in parallel with the bore axis. Thus, the mixed gas is permitted to flow therein at a high speed, which is substantially equal to that in the venturi portion, without decrease in speed, and thus the fuel will not deposit on the wall of bore and/or on the lower surface of the suction piston. Accordingly, the air-fuel ratio is prevented from undesired variation. On the other hand, at the time of larger amount of intake air, the throttle valve takes a vertical orientation, and at least one of the bulkheads will not extend beyond the width of the throttle shaft, thereby preventing a decreased output.

DETAILED DESCRIPTION OF THE PREFERRED EMBODIMENTS

Figure 1:
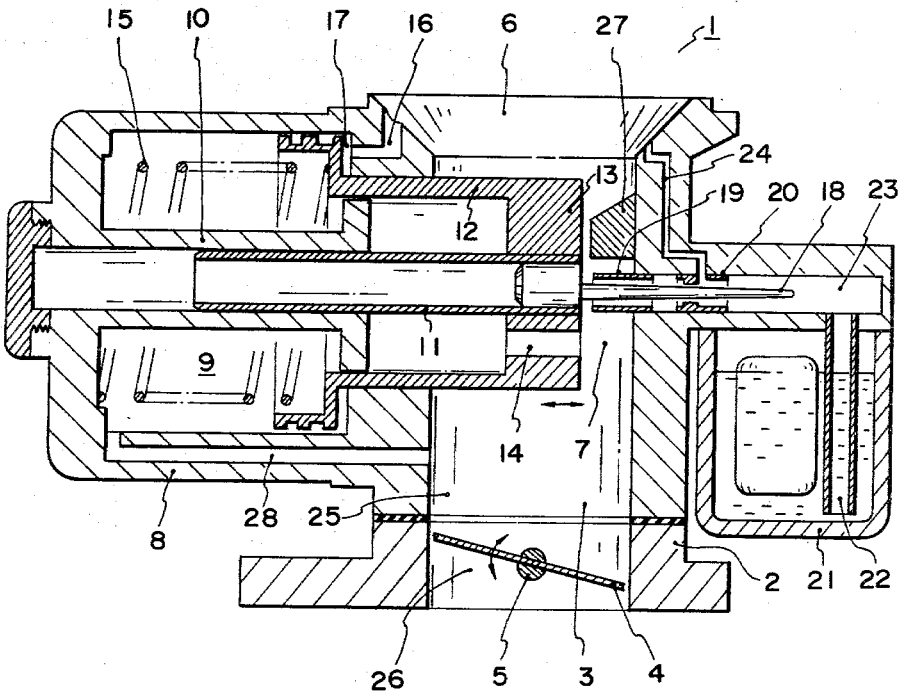
FIG. 1 is an explanatory axial, cross-sectional view of a prior art variable-venturi carburetor.

Before turning to a detailed consideration of the illustrative, preferred embodiments, a detailed description of a conventional variable-venturi carburetor is in order and will serve to aid in understanding the present invention.

According to FIG. 1, a conventional variable-venturi carburetor 1 is described below. When a throttle valve 4, which is provided downstream in a bore 3 formed by a barrel 2, makes opening-and-closing operation by rotational movement thereof about its throttle shaft 5, a corresponding amount of air will, in response to such operation of the valve 4, be taken in from an air horn 6, which is provided upstream, and flow down through a venturi portion 7. With such air flow, a suction piston 12, which is slidably supported on a rod 11 fitted in a rod guide 10 extending into a suction chamber 8 provided on one side of the barrel 2 and is adapted to form a negative pressure chamber 9 within the suction chamber 8, will be moved forward and backward according to balancing relationship appearing between a negative pressure introduced in the negative pressure chamber 9 through a negative pressure passage 14 formed in a head 13 of the piston 12, a suction spring 15 interposed between the suction piston 12 and the suction chamber 8, and the atmospheric pressure in an atmospheric air chamber 17 which is in communication through a communication passage 16 with the air horn 6. Such movement of the suction piston 12 will, in its turn, change the sectional area of the venturi portion 7. Concurrently with the movement of the piston 12, a metering needle 18, which is secured to the head 13 by forcing the base portion of the needle 18 into the head 13, will move forward and backward passing through a main nozzle 19 and a metering jet 20 provided in the barrel 2 while being centering in them. In this manner, the metering needle 18 will, in cooperation with the metering jet 20, meter fuel which is sucked in from a float chamber 21 through a suction pipe 22 and a fuel passage 23, and permit the fuel to spout out from the main nozzle 19 together with bleed air drawn in through an air bleed passage 24 which is communicated with the air horn 6. Such spouted fuel will then be mixed with the air flowing down through the venturi portion 7 to form mixture of atomized fuel particles and air which will then be sent through a mixing chamber 25 and a throttle bore 26 into a fuel chamber.

In FIG. 1, the numeral 27 indicates a bridge, and the numeral 28 indicates a passage for draining residual fuel in the negative pressure chamber 9.

Differing from a fixed-venturi carburetor, the conventional variable-venturi carburetor 1 is of a single-bore structure, and accordingly the throttle bore 26 has, in order to assure a sufficient output-performance, a diameter of as large as 40 to 45 mm which represents a sectional area of two or three times as large as that of the low-speed throttle bore of the fixed-venturi carburetor.

Accordingly, at the time when the head 13 of the suction piston 12 comes nearer to the bridge 27 to make the sectional area of the venturi portion 7 smaller to permit as smaller amount of mixed gas of fuel and air to be taken in, the mixed gas will pass through the venturi portion 7 at a speed of as high as several tens of m/sec, but the speed of the gas in the throttle bore 26 will be rapidly decreased to several m/sec which is very low as compared with that in the fixed-venturi carburetor.

As a result, though, on one hand, atomization of fuel can be enhanced by the high-speed gas stream to produce good mixing of atomized particles of fuel and air in the venturi portion 7, on the other hand, in the throttle bore 26 or in the throttle bore 26 and in the vicinity of the mixing chamber 25, a considerably large amount of fuel will deposit on the wall of the bore 3 and/or on the lower surface of the suction piston 12 in a wet state and will drip down as irregular drips, thus causing variation in the normal air-fuel ratio characteristic and injuring operational performance. Further, in the transient stage, amount of the deposited fuel itself will vary, thus injuring the normal, intrinsic transient characteristic of the variable-venturi carburetor, resulting in a lean state at the time of acceleration and in a rich state at the time of deceration. Such problems as the above have been a bottleneck against maintenance of a correct air-fuel ratio which is required, as described above, for effective action of the three-way catalytic converter.

Embodiments of the invention will now be described in connection with FIG. 2 and the succeeding figures. In these figures, like parts as in FIG. 1 will be indicated by the same numerals.

Figure 2:
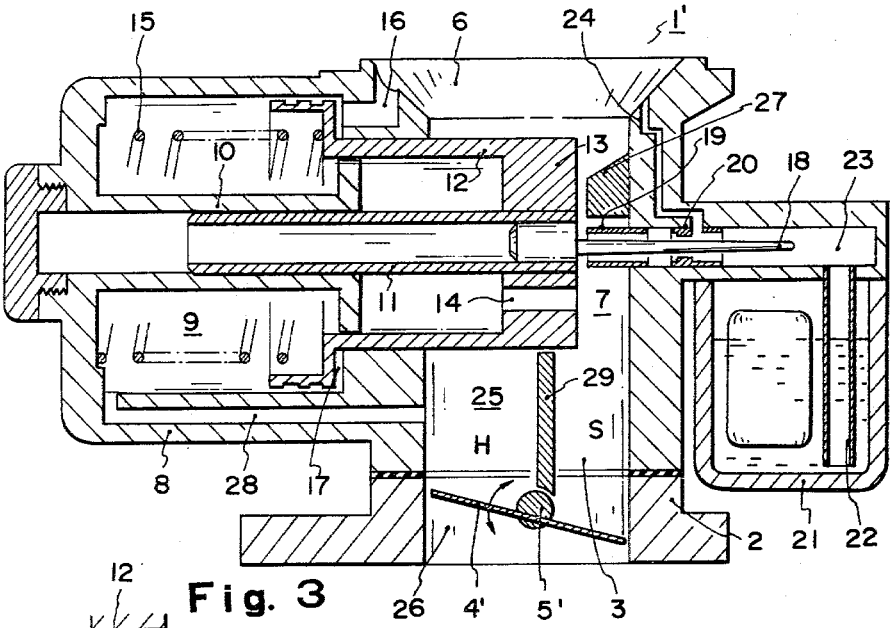
FIG. 2 is an axial, cross-sectional view of a variable-venturi carburetor according to an illustrative, preferred embodiment of the present invention.
Figure 3:
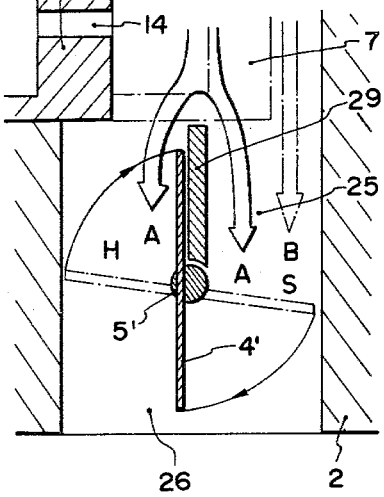
FIG. 3 is a partial enlarged view of FIG. 2 useful in understanding the operation of the embodiment illustrated in FIG. 2.

The embodiment shown in FIGS. 2 and 3 differs from the carburetor of FIG. 1 in the construction of the downstream bore 3. In the construction shown in FIGS. 2 and 3, a downstream throttle valve 4' provided in the bore 3 in the barrel 2 is secured to a throttle shaft 5' in a manner that the valve is downward off-centered with respect to the center of shaft when the valve fully extends across the bore 3. The venturi portion 7 is provided between the bore 3 and the upstream air horn 6. On one side of the venturi portion 7 is provided the suction chamber 8 integrally to the barrel 2 to form therein the negative pressure chamber 9. In the hole formed in the rod guide 10, which internally extends from the rear wall of the negative pressure chamber 9, is slidably supported the rod 11 of the suction piston 12 which has its head 13 placed perpendicular to the venturi portion 7 so that the sectional area thereof can be increased and decreased by the head.

The numeral 14 indicates the negative pressure passage formed in the head 13 of the suction piston 12 for introducing a negative pressure into the negative pressure chamber 9. The suction spring 15 provided within the negative pressure chamber 9, the suction piston 12, the atmospheric air chamber which is formed by the barrel 2 and the suction chamber 8 and is communicated through the communication passage 16 with the air horn 6, and the above-mentioned negative pressure chamber constitute in combination with one another a travelling mechanism for the suction piston 12.

Accordingly, the variable-venturi carburetor 1' as described above constitutes a variable-venturi carburetor of the air-damper type.

The numeral 18 indicates the metering needle which has its base portion secured to the head 13 of the suction piston 12 by forcing the base portion into the head and is inserted into the main nozzle 19 and the metering jet 20, which is disposed behind the main nozzle 19, in the barrel 2, the needle 18 centering in the nozzle 19 and the jet 20.

The numeral 21 indicates the float chamber provided on the other side of the barrel 2, the suction pipe 22 of which chamber opens in the fuel passage 23 which communicates with the metering jet 20.

To the metering jet 20 is connected the air bleed passage 24 which communicates with the air horn 6. The numeral 25 indicates the mixing chamber which is provided downstream with respect to the venturi portion 7 and is formed integrally to the throttle bore portion 26 which is located downstream with respect to the mixing chamber 25. Within the mixing chamber 25 is provided a bulkhead 29 which characterizes the invention. The bulkhead 29 is located parallel to the axis of the bore 3 and in a plane which includes therein the throttle shaft 5'. The bulkhead 29 has a thickness not exceeding that of the throttle shaft 5', and is fixed with respect to the barrel 2 in a manner that the bulkhead 29 may be within the diameter of the throttle shaft 5' as viewed from the vertical direction when the throttle valve 4' fully extends across the bore 3.

In particular, the bulkhead 29 is virtually sealed by the throttle shaft 5' which is positioned at the lower end of the bulkhead 29.

The thickness of the bulkhead 29 may be a thickness which cannot be deformed by pressure of the mixed gas flowing down through the bore 3, through the thickness of bulkhead is illustrated in the figure in an enlarged scale by reason of convenience.

The numeral 27 indicates the bridge which is provided in the upstream portion near the main nozzle 19 and internally extends within the barrel 2. The numeral 28 indicates the draining passage for residual fuel in the negative pressure chamber 9. The passage 28 is communicated with the mixing chamber 25 and the negative pressure chamber 9.

In the above-described construction, during operation of engine, amount of air taken in from the air horn 6 depends on the degree of opening of the throttle valve 4'. A negative pressure produced in the venturi portion 7 will be introduced through the negative pressure passage 14 of the suction piston 12 into the negative pressure chamber 9, and, as described above, the suction piston 12 will be moved forward and backward according to balancing relationship appearing between such negative pressure introduced into the negative pressure chamber 9, resilient force of the suction spring 15 and the atmospheric pressure in the atmospheric air chamber 17, so that the sectional area of the venturi portion 7 can be increased and decreased. Together with the movement of the suction piston 12, the metering needle 18 will move forward and backward to meter, in cooperation with the metering jet 20, fuel which is sucked in through the suction pipe 22 from the float chamber 21. Such sucked fuel will then spout out from the main nozzle 19 together with bleed air introduced through the air bleed passage 24, be broken into small particles in the venturi portion 7, be formed into finer particles in the suction chamber 25, and then be sent from the throttle bore portion 26 to the fuel chamber.

In the state shown by solid line in FIG. 2 and by dot-bar line in FIG. 3, i.e., in the state of low-speed running, the throttle valve 4' takes a position of closing relative to the bore, and the head 13 of the suction piston 12 is at a position near the bulkhead 29 or extends beyond the bulkhead 29 as shown in the figure.

Accordingly, the mixed gas which has passed through the venturi portion 7 will, on its way to the mixing chamber 25, flow along a slow-speed side S, which is defined and formed on the right-hand side (in the figure) by the bulkhead 29, in a form of substantially regulated stream without dispersing widely, as shown by the dot-bar arrow B, that is to say, the gas will flow along the slow-speed side S and through the throttle bore portion 26 while maintaining its initial speed, i.e., at a speed of two to three times as high as the speed which would be effected in case there were no bulkhead.

As a result, since there is no decrease in speed of the mixed gas flowing through the mixing chamber 25 and the throttle bore portion 26, no fuel will deposit on the wall of the throttle bore portion and on the lower surface of the suction piston, and accordingly there will be no dripping-down of fuel, particularly during the transient stage. Consequently, the air-fuel ratio characteristic will not vary; accordingly, the three-way catalytic converter operates as designed, its affect not being reduced.

On the other hand, when the throttle valve 4' takes the fully open position as shown by solid line in FIG. 3, the throttle valve becomes parallel to the bulkhead 29 with substantial contact therebetween, both the throttle valve and the bulkhead being contained within the diameter of the throttle shaft 5'. Accordingly, the mixed gas flowing through the venturi portion 7, which has been enlarged by retraction of the suction piston 12, can flow along both a high-speed side H and the slow-speed side S which are divided from each other by the throttle valve 4' and the bulkhead 29, and be sent to the fuel chamber, this being substantially the same as in the conventional structure.

In such state, since both the throttle valve 4' and the bulkhead 29 are contained within the projection area of the throttle shaft 5' as described above, there will be no substantial decrease in output.

The mixed gas is transported as a result of the intake-pulsation of the engine, when the throttle valve 4' is quickly opened at the time of rapid acceleration from the low speed situation.

In the condition, intake air is less and the suction piston 13 is not fully opened, but sealing of the bulkhead 29 by the throttle shaft 5' at its lower end prevents much of fuel from being deposited on the rear surface of the bulkhead 29 as it flows past.

According, the fuel supply to the engine is not insufficient, even during rapid acceleration from low speed, thus drivability during acceleration does not become worse.

Figure 4:
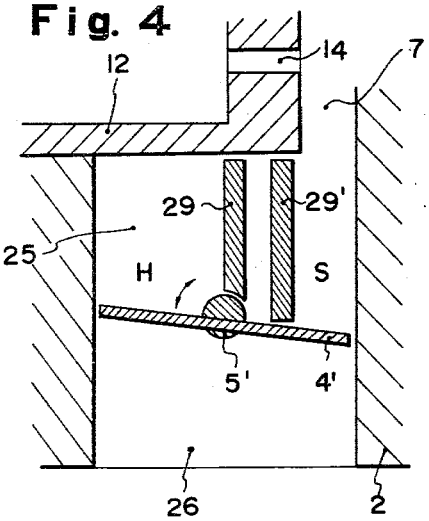
FIG. 4 is an axial, cross-sectional view similar to that of FIG. 3 showing another embodiment of the present invention.

An embodiment shown in FIG. 4 includes in the slow-speed side S another bulkhead 29' which is provided in addition to the bulkhead 29 with a setting interval h therebetween, so that dispersion and liability to lower speed of the mixed gas at the time of low speed running can be restrained in a greater number of steps, thus greater prevention against fuel deposition being effected.

Embodiments of the invention are not limited to the above-described embodiments. The number of bulkheads may be three or more. Position of the throttle shaft may be shifted to the high-speed side to accommodate greater number of bulkheads so that liability to lower speed of high-speed mixed gas can be restrained according to amount of intake air.

The invention can be applied not only to variable-venturi carburetors of the air-damper type but also to those of the conventional oil-damper type.

As will be seen from the above description, according to the invention, in a variable-venturi carburetor having an air horn and a throttle valve provided respectively upstream and downstream to form a venturi portion therebetween, a suction chamber provided on one side of the venturi portion, and a suction piston adapted to operate in a balancing manner with respect to the suction chamber through a negative pressure chamber and an atmospheric pressure chamber in the suction chamber, the suction piston having a rod which is slidably supported by a rod guide of the suction chamber, there is provided within a mixing chamber in a bore at least one bulkhead disposed in a plane which extends along and is on the side of a main nozzle with respect to a plane which includes therein the shaft of the throttle valve and extends in the direction of the bore axis, so that, at the time of low-speed running when the suction piston advances to make the sectional area of the venturi portion narrower resulting in a smaller relative sectional area of the venturi portion with respect to that of the mixing chamber and a throttle bore and in a higher speed of mixed gas flowing through the venturi portion, the mixed gas can, on its way from the venturi portion to the mixing chamber, be regulated by the bulkhead so as not to disperse widely in the mixing chamber of a larger sectional area, and accordingly the mixed gas can maintain its high flowing speed and fuel contained in the mixed gas will not deposit on the wall of the mixing chamber and/or on the lower surface of the suction piston, and accordingly there will be no dripping down of fuel, thus no variation being effected in air-fuel ratio.

Especially, by providing a plurality of bulkheads, regulation on the slow-speed side in the mixing chamber can be made in a stepped manner according to amount of advance of of the suction piston, and thus the above-described merit can be further enhanced.

Due to such stableness in air-fuel ratio, especially due to the stableness during the transient stage, exhaust gas having a constant air-fuel ratio can be effected, and accordingly sure reduction of HC, CO and NOx by the three-way catalytic converter can be obtained.

The bulkhead is oriented in the direction of the bore axis, and thus, at the time of high-speed running, substantially no decrease will occur in flow of the mixed gas and accordingly in output.

It is to be understood that the present invention is not limited to the embodiments illustrated and described above. Numerous other embodiments and variations are possible without departing from the spirit and scope of the invention, its scope being defined in the appended claims.

What is claimed is:

1. In a variable-venturi carburetor having a throttle valve with a shaft having a given axis and provided downstream in a bore with an axis, an air horn provided upstream, a venturi portion formed between the throttle valve and the air horn, a main nozzle provided on one side of the venturi portion, a suction chamber provided on the other side of the venturi portion, and a suction piston having a rod slidably supported by a rod guide of the suction chamber and forming between the suction chamber and the suction piston a negative pressure chamber with a suction spring therebetween, the suction piston being capable of moving forward and backward in a direction substantially perpendicular to the venturi portion, the improvement wherein there is provided within said mixing chamber in said bore at least one bulkhead disposed substantially along a given plane which includes therein said given axis of said shaft of said throttle valve and extends in the direction of said axis of said bore, said throttle valve being pivotable substantially perpendicular to said given plane, said bulkhead being positioned on the side of said main nozzle with respect to said plane and having its lower end positioned adjacent to said shaft of said throttle valve virtually sealing said lower end of said bulkhead.

2. An improved variable-venturi carburetor in accordance with claim 1, wherein said bulkhead is a single plate disposed substantially along said given axis of said shaft of said throttle valve.

3. An improved variable-venturi carburetor in accordance with claim 2, wherein said throttle shaft has a given diameter and thickness of said bulkhead is less than said diameter of said throttle shaft.

4. An improved variable-venturi carburetor in accordance with claim 3, wherein said thickness of said bulkhead is within a width defined by a flat surface of said throttle valve when in a vertical position and lies substantially in a vertical plane which is tangent to the circumference of said throttle shaft.

5. An improved variable-venturi carburetor in accordance with claim 1, including at least one further bulkhead positioned in said bore, substantially parallel to the first said bulkhead.

6. An improved variable-venturi carburetor in accordance with claim 1, wherein said throttle valve is positioned on said shaft thereof and off-set toward down stream when said throttle valve is positioned to its shut-off condition.

7. An improved variable-venturi carburetor in accordance with claim 1, wherein the position of said throttle shaft is to the high-speed side.

8. An improved variable-venturi carburetor in accordance with claim 5, wherein said at least one further bulkhead is positioned with respect to said throttle shaft to the low-speed side.

* * * * *